US012402761B1

(12) United States Patent
Breed

(10) Patent No.: US 12,402,761 B1
(45) Date of Patent: Sep. 2, 2025

(54) TISSUE COVER

(71) Applicant: Clifford B. Breed, Fort Worth, TX (US)

(72) Inventor: Clifford B. Breed, Fort Worth, TX (US)

( * ) Notice: Subject to any disclaimer, the term of this patent is extended or adjusted under 35 U.S.C. 154(b) by 63 days.

(21) Appl. No.: 18/126,832

(22) Filed: Mar. 27, 2023

(51) Int. Cl.
*A47K 10/40* (2006.01)
*A47K 10/32* (2006.01)

(52) U.S. Cl.
CPC ..... *A47K 10/40* (2013.01); *A47K 2010/3233* (2013.01)

(58) Field of Classification Search
USPC ..... 242/598.6
See application file for complete search history.

(56) References Cited

U.S. PATENT DOCUMENTS 1,423,336 A * 7/1922 Korittke ..... A47K 10/34 225/53
2,304,312 A * 12/1942 Meglitz ..... A47K 10/38 225/53
2,579,201 A 12/1951 Pendergast
2,586,501 A * 2/1952 Baar ..... A47K 10/38 225/39
2,592,955 A * 4/1952 Roddan ..... C10L 1/14 242/598.6
2,668,022 A * 2/1954 Fairfield ..... A47K 10/38 225/41
4,398,686 A * 8/1983 Leger ..... B64D 1/12 244/137.3
4,721,264 A 1/1988 Muscarello
4,739,943 A 4/1988 Geller
4,957,246 A 9/1990 Kantor
D397,891 S 9/1998 Thompson
6,056,233 A * 5/2000 Von Schenk ..... A47K 10/40 242/598.5
6,405,972 B1 6/2002 Wakam
8,991,647 B2 3/2015 Meyers
2005/0156081 A1* 7/2005 Schaeffer ..... A47K 10/38 242/598.6
2012/0211587 A1* 8/2012 Caldwell ..... B65H 49/325 242/598
2013/0334272 A1* 12/2013 Granger ..... A47K 10/38 225/88
2016/0135652 A1* 5/2016 Cittadino ..... B65H 23/06 225/42
2019/0174973 A1* 6/2019 Ahmed ..... A47K 10/22
2020/0305657 A1* 10/2020 McCachren ..... A47K 10/38

* cited by examiner

*Primary Examiner* — William A. Rivera
(74) *Attorney, Agent, or Firm* — Cramer Patent & Design, PLLC.; Aaron R. Cramer

(57) ABSTRACT

The present invention is directed to a tissue cover. The tissue cover may comprise a base, a cover, a brush, and a toilet paper holder. The tissue cover may be a dispenser for a roll of toilet paper. The dispenser may sit on a bathroom counter or mount onto a bathroom wall. The roll of toilet paper may be placed on the toilet paper holder within the dispenser such that sheets of toilet paper feed out of the dispenser through a gap between the front of the base and the front of the cover. The base may comprise the brush that restricts the spread of paper dust shed by the roll of toilet paper. The cover may pivot to facilitate changing the roll of toilet paper.

1 Claim, 3 Drawing Sheets

TISSUE COVER

RELATED APPLICATIONS

None.

FIELD OF THE INVENTION

The present invention relates generally to a cover and more specifically to a cover for tissue such as toilet tissue.

BACKGROUND OF THE INVENTION

Many people in the world today seem fixated on the issue of whether the toilet paper should come off the top or the bottom of the roll. While certainly a fun topic to discuss, such an issue does not necessarily represent a calamity or even a hardship if one should have to deal with a roll of toilet paper not to their liking. However, one aspect of toilet paper usage that we all must face regardless of how the paper exits the roll, is the resultant paper dust that accumulates on the dispenser, floor and wall around the area of the dispenser.

Ironically, the more premium the toilet paper is, the greater the amount of dust that seems to accumulate. Accordingly, there exists a need for a means by which a toilet paper dust on exterior surfaces surrounding dispensers can be eliminated or reduced. The development of the toilet tissue cover fulfills this need.

SUMMARY OF THE INVENTION

To achieve the above and other objectives, the present invention provides for a tissue cover having a base having a base bottom wall, a base rear wall, a base first side wall, and a base second side wall, a cover having a cover top wall, a cover first side wall, and a cover second side wall, the cover protects a roll of toilet paper and covers the base in order to contain a plurality of paper dust within the base and to facilitate changing the roll of toilet paper, a brush coupled to the front of the base bottom wall, a toilet paper holder having a first portion with a first end and a second portion with a second end, the toilet paper holder is disposed within the base, and a dispenser dispensing one or more sheets from the roll of toilet paper.

The base rear wall may be a pair of inverted keyholes for keyhole mounting the dispenser to a bathroom wall. The base rear wall may be vertically oriented and located at the rear of the dispenser and the bottom of the base rear wall is coupled to the rear of the base bottom wall. The side walls may be selected from the group consisting of a plurality of straight bottom edge side walls, a plurality of straight rear edge side walls, and a plurality of arcing top edge side walls.

The base first side wall includes a first centering well on the interior of the base and the base second side wall may include a second centering well on the interior of the base. The first centering well may be laterally opposite the second centering well such that the toilet paper holder is supported between the base first side wall and the base second side wall by the first centering well and the second centering well. The first centering well may be laterally opposite the second centering well such that the toilet paper holder is supported between the base first side wall and the base second side wall by the first centering well and the second centering well. The first end of the first portion may fit within the first centering well of the base and the second end of the second portion fit within the second centering well of the base.

The base first side wall may include a first cover peg on the interior top rear corner of the base first side wall and the base second side wall includes a second cover peg on the interior top rear corner of the base. The first cover peg may be laterally opposite the second cover peg such that the cover pivotably couples to the base via the first cover peg and the second cover peg.

The cover first side wall may include a first cover aperture for engaging the first cover peg on the base and the cover second side wall includes a second cover aperture for engaging the second cover peg on the base. The cover top wall may be a curved plate that covers the top of the base and matches the curve of the arcing top edge of the base first side wall and the base second side wall. The cover top wall may be wider than the base such that the cover first side wall and the cover second side wall extend downward from the first and second edges of the cover top wall outside of the base and the cover top wall extends from the top of the base rear wall to the front of the base bottom wall. The cover first side wall extends downwards from a first edge of the cover top wall and the cover second side wall extends downwards from a second edge of the cover top wall.

A plurality of bottom edges of the cover first side wall and the cover second side wall may form a decorative curve that reaches less than halfway to an intersection of the base bottom wall and the base rear wall. The cover may be made of clear plastic such that the roll of toilet paper is visible within the dispenser with the cover closed. The brush may deform as the sheets of toilet paper pass through the gap such that the roll of toilet paper is dispensed contiguously. The brush may be a strip of felt coupled to the front of the base bottom wall. The toilet paper holder is a spring-loaded cylindrical support for the roll of toilet paper and is adapted to pass through a cardboard center tube of the roll of toilet paper and then install within the base. The roll of toilet paper may be placed on the toilet paper holder within the dispenser such that one or more sheets of toilet paper feed out of the dispenser through a gap between the front of the base and the front of the tissue cover.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
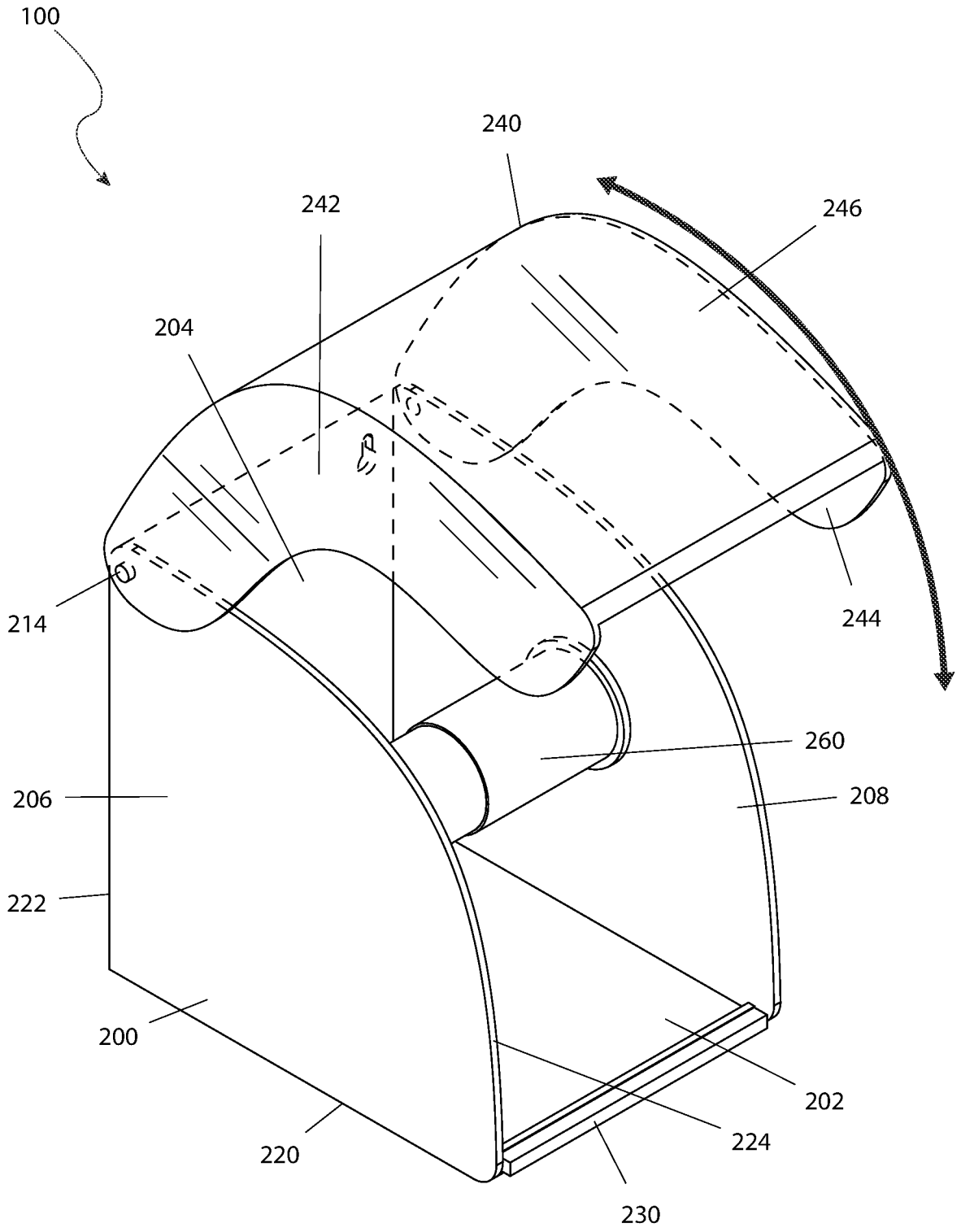
FIG. 1 is an isometric view of a tissue cover, according to an embodiment of the present invention, illustrating the cover open and no roll of toilet paper installed.
Figure 3:
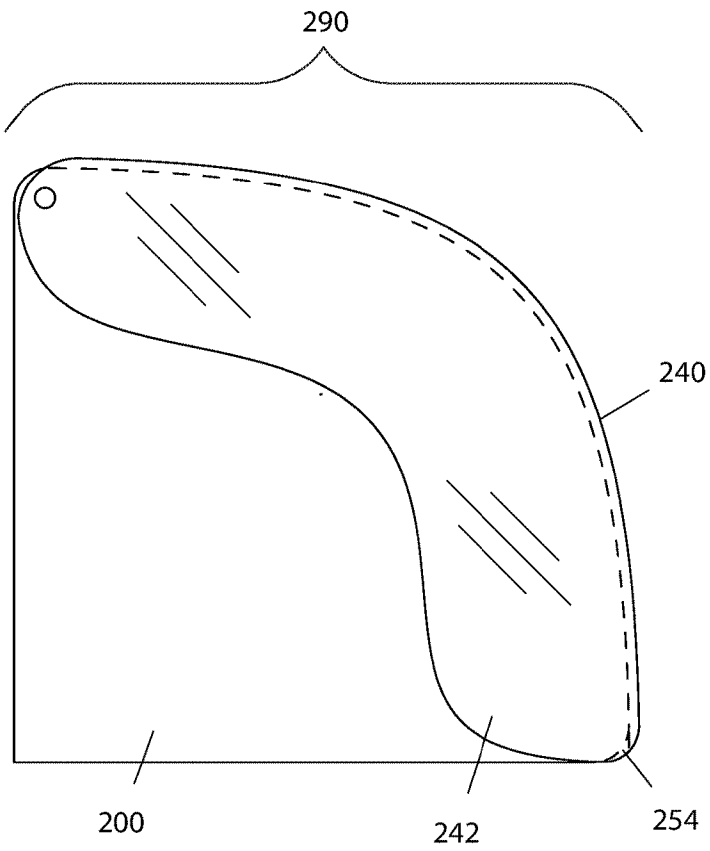
FIG. 3 is a side view of a tissue cover, according to an embodiment of the present invention, illustrating the cover closed and no roll of toilet paper installed.
Figure 2:
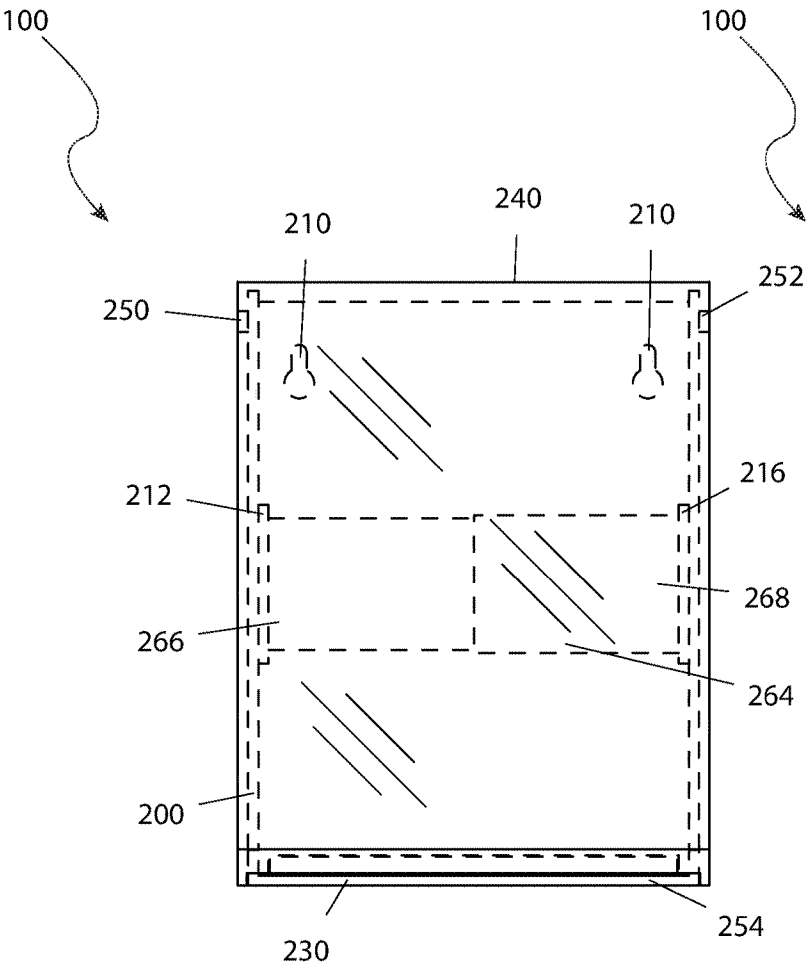
FIG. 2 is a front view of a tissue cover, according to an embodiment of the present invention, illustrating the cover closed and no roll of toilet paper installed.
Figure 5:
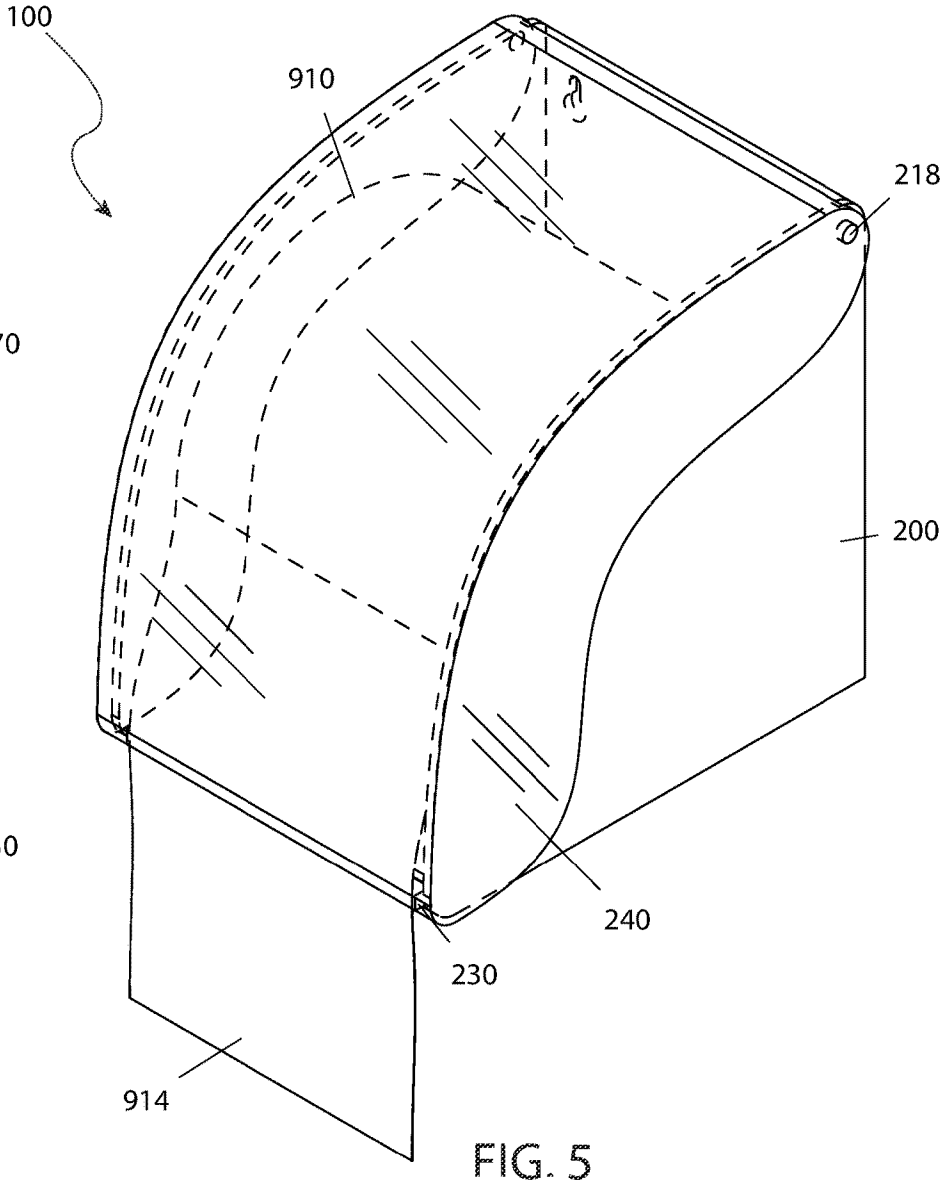
FIG. 5 is an isometric rear view of a tissue cover, according to an embodiment of the present invention, illustrating the cover close and a roll of toilet paper installed.
Figure 4:
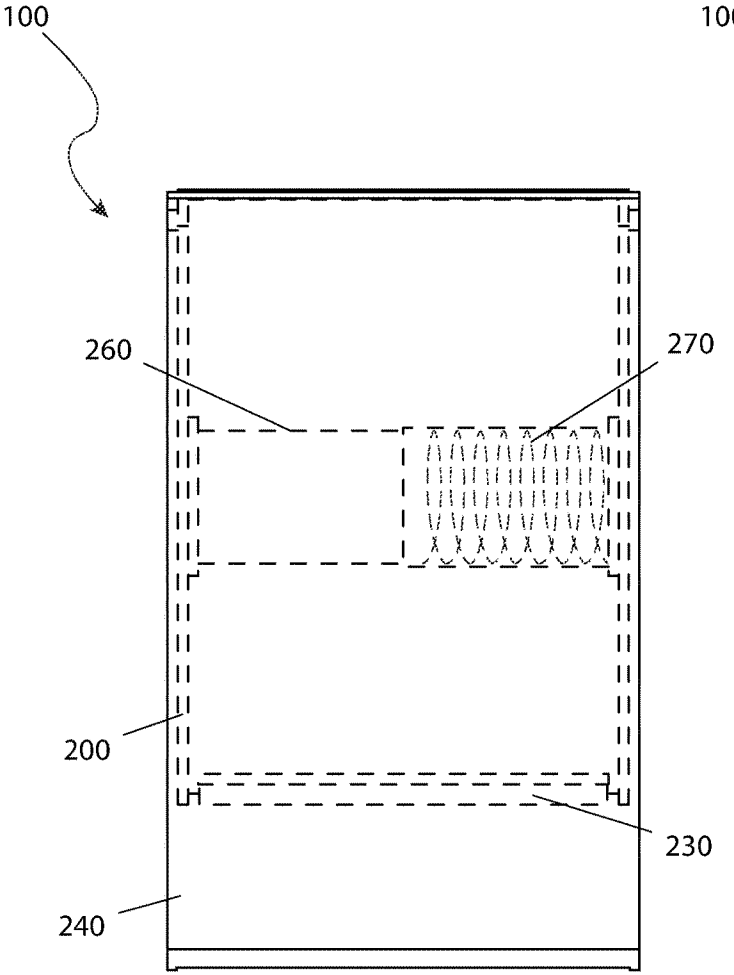
FIG. 4 is a top view of a tissue cover, according to an embodiment of the present invention, illustrating the cover open and no roll of toilet paper installed.

100 tissue cover
200 base

202 base bottom wall
204 base rear wall
206 base first side wall
208 base second side wall
210 inverted keyhole
212 first centering well
214 first cover peg
216 second centering well
218 second cover peg
220 straight bottom edge
222 straight rear edge
224 arcing top edge
230 brush
240 cover
242 cover first side wall
244 cover second side wall
246 cover top wall
250 first cover aperture
252 second cover aperture
254 gap
260 toilet paper holder
262 first portion
264 second portion
266 first end
268 second end
270 internal spring
290 dispenser
910 roll of toilet paper
914 sheets of toilet paper

DESCRIPTION OF THE INVENTION

The present invention is directed to a tissue cover (herein described as the "invention") 100. The invention 100 may comprise a base 200, a cover 240, a brush 230, and a toilet paper holder 260. The invention 100 may be a dispenser 290 for a roll of toilet paper 910. The dispenser 290 may sit on a bathroom counter or mount onto a bathroom wall. The roll of toilet paper 910 may be placed on the toilet paper holder 260 within the dispenser 290 such that sheets of toilet paper 914 feed out of the dispenser 290 through a gap 254 between the front of the base 200 and the front of the cover 240. The base 200 may comprise the brush 230 that restricts the spread of paper dust shed by the roll of toilet paper 910. The cover 240 may pivot to facilitate changing the roll of toilet paper 910.

The base 200 may comprise a base bottom wall 202, a base rear wall 204, a base first side wall 206, and a base second side wall 208. The base bottom wall 202 may be horizontally oriented and located at the bottom of the dispenser 290 such that the dispenser 290 may rest on the base bottom wall 202 when place on the bathroom counter. The base rear wall 204 may be vertically oriented and located at the rear of the dispenser 290. The bottom of the base rear wall 204 may be coupled to the rear of the base bottom wall 202. The base rear wall 204 may comprise a pair of inverted keyholes 210 for keyhole mounting the dispenser 290 to the bathroom wall.

The base first side wall 206 may define the first side of the base 200 and the base second side wall 208 may define the second side of the base 200. An individual side wall selected from the base first side wall 206 and the base second side wall 208 may comprise a straight bottom edge 220, a straight rear edge 222, and an arcing top edge 224. The straight bottom edge 220 of the individual side wall may be coupled to the base bottom wall 202. The straight rear edge 222 of the individual side wall may be coupled to the base rear wall 204. The arcing top edge 224 may extend from the top of the straight rear edge 222 to the front of the straight bottom edge 220.

The base first side wall 206 may comprise a first centering well 212 on the interior of the base 200. The base second side wall 208 may comprise a second centering well 216 on the interior of the base 200. The first centering well 212 may be laterally opposite the second centering well 216 such that the toilet paper holder 260 may be supported between the base first side wall 206 and the base second side wall 208 by the first centering well 212 and the second centering well 216.

The base first side wall 206 may comprise a first cover peg 214 on the interior top rear corner of the base first side wall 206. The base second side wall 208 may comprise a second cover peg 218 on the interior top rear corner of the base 200. The first cover peg 214 may be laterally opposite the second cover peg 218 such that the cover 240 may pivotably couple to the base 200 via the first cover peg 214 and the second cover peg 218.

The cover 240 may cover the base 200 in order to contain the paper dust within the dispenser 290. The cover 240 may comprise a cover top wall 246, a cover first side wall 242, and a cover second side wall 244. The cover 240 may pivotably couple to the top rear of the base 200. In some embodiments, the cover 240 may be made of clear plastic such that the roll of toilet paper 910 may be visible within the dispenser 290 with the cover 240 closed.

The cover top wall 246 may be curved plate that covers the top of the base 200. The curve of the cover top wall 246 may match the curve of the arcing top edge 224 of the base first side wall 206 and the base second side wall 208. The cover top wall 246 may be wider than the base 200 such that the cover first side wall 242 and the cover second side wall 244 may extend downward from the first and second edges of the cover top wall 246 outside of the base 200. The cover top wall 246 may extend from the top of the base rear wall 204 to the front of the base bottom wall 202.

The cover first side wall 242 may extend downwards from the first edge of the cover top wall 246. The cover second side wall 244 may extend downwards from the second edge of the cover top wall 246. The cover first side wall 242 and the cover second side wall 244 may flank the base 200. In some embodiments, the bottom edges of the cover first side wall 242 and the cover second side wall 244 may form a decorative curve that reaches less than halfway to the intersection of the base bottom wall 202 and the base rear wall 204.

The cover first side wall 242 may comprise a first cover aperture 250 for engaging the first cover peg 214 on the base 200. The cover second side wall 244 may comprise a second cover aperture 252 for engaging the second cover peg 218 on the base 200. The cover 240 may pivot at the first cover aperture 250 and the second cover aperture 252 in order to open and close.

The brush 230 may be coupled to the front of the base bottom wall 202. The brush 230 may be operable to fill the gap 254 between the front of the base bottom wall 202 and the bottom of the cover top wall 246 to prevent the paper dust from leaving the dispenser 290. The brush 230 may deform as the sheets of toilet paper 914 pass through the gap 254 such that the roll of toilet paper 910 may be dispensed contiguously.

In some embodiments, the brush 230 may be a strip of felt coupled to the front of the base bottom wall 202. In some embodiments, the brush 230 may comprise a plurality of bristles that are horizontally oriented front to rear with the rear of each of the plurality of bristles coupled to the base bottom wall 202. In some embodiments, the plurality of bristles may be plush, meaning that the plurality of bristles may be longer and less dense than velvet pile. As non-limiting examples, the plurality of bristles may be made of silk, cotton, wool, and any combination thereof.

The toilet paper holder 260 may be a spring-loaded cylindrical support for the roll of toilet paper 910. The toilet paper holder 260 may be configured to pass through a cardboard center tube of the roll of toilet paper 910 and then install within the base 200. The roll of toilet paper 910 may rotate around the toilet paper holder 260 as the sheets of toilet paper 914 are dispensed.

The toilet paper holder 260 may comprise a first portion 262 and a second portion 264. The first portion 262 and the second portion 264 may comprise at least one-half (½) of the toilet paper holder 260. The first portion 262 may be different diameters such that the first portion 262 may slide into and out of the second portion 264, or vice versa. An internal spring 270 within the toilet paper holder 260 may be operable to push the first portion 262 away from the second portion 264 unless countered by an external compressing force.

A first end 266 of the first portion 262 may fit within the first centering well 212 of the base 200 and a second end 268 of the second portion 264 may fit within the second centering well 216 of the base 200.

In use, the dispenser 290 may be placed on a bathroom counter or mounted on a bathroom wall via the pair of inverted keyholes 210. A roll of toilet paper 910 may be placed within the dispenser 290 supported by the toilet paper holder 260. The end of the roll of toilet paper 910 may be pulled forward to extend beyond the front of the base 200 and the cover 240 may be closed. The sheets of toilet paper 914 may be dispensed by pulling the sheets of toilet paper 914 out of dispenser and ripping them off. Paper dust may be contained within the dispenser 290 and prevented from exiting the dispenser 290 by the base 200, the cover 240 and the brush 230.

The exact specifications, materials used, and method of use of the invention 100 may vary upon manufacturing. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A tissue cover consisting of:

a base consisting of:

a horizontally oriented base bottom wall;

a vertically oriented base rear wall coupled to a rear edge of the base bottom wall;

a base first side wall; and, a base second side wall; and, wherein the base rear wall includes a pair of inverted keyholes for mounting the tissue cover dispenser to a wall;

a cover consisting of:

a curved cover top wall extending from a top of the base rear wall to a front region of the base bottom wall;

a cover first side wall extending downward from a first lateral edge of the cover top wall; and, a cover second side wall extending downward from a second lateral edge of the cover top wall and flanking the base; and, wherein the cover first side wall includes a first cover aperture and the cover second side wall includes a second cover aperture;

a first cover peg disposed on an interior top rear corner of the base first side wall and a second cover peg disposed on an interior top rear corner of the base second side wall; and, wherein the first cover aperture and the second cover aperture pivotably engage the first cover peg and the second cover peg, respectively, to couple the cover to the base;

a spring-loaded toilet paper holder consisting of:

a first portion slidably received within a second portion and biased outward by an internal spring; and, wherein a first end of the first portion is received within a first centering well in the base first side wall and a second end of the second portion is received within a second centering well in the base second side wall such that a roll of toilet paper is rotatably supported within the base;

a brush fixed to a front region of the base bottom wall, wherein the brush extends into a gap between the cover and the base and is deformable such that the brush contacts the roll of toilet paper as it is dispensed, thereby reducing the release of paper dust; and, wherein the cover is made of clear plastic such that the roll of toilet paper is visible within the tissue cover dispenser when the cover is in a closed position.

* * * * *